United States Patent [19]

Kneidel

[11] Patent Number: 5,044,426

[45] Date of Patent: Sep. 3, 1991

[54] VARIABLE CONDUCTANCE HEAT PIPE ENHANCEMENT

[75] Inventor: Kurt E. Kneidel, Alliance, Ohio

[73] Assignee: The Babcock & Wilcox Company, New Orleans, La.

[21] Appl. No.: 492,521

[22] Filed: Mar. 12, 1990

[51] Int. Cl.[5] ..... F28D 15/02

[52] U.S. Cl. ..... 165/32; 165/104.14; 165/104.27

[58] Field of Search ..... 165/32, 104.27, 104.14, 165/921

[56] References Cited

U.S. PATENT DOCUMENTS 3,782,449 1/1974 Busse et al. ..... 165/32

4,917,178 4/1990 Kosson et al. ..... 165/32

FOREIGN PATENT DOCUMENTS 161692 9/1984 Japan ..... 165/32

*Primary Examiner*—Albert W. Davis, Jr.

*Attorney, Agent, or Firm*—Vytas R. Matas; Robert J. Edwards; Daniel S. Kalka

[57] ABSTRACT

A heat pipe having an internal cross-sectional area contains a fixed restriction member with a reduced cross-sectional area, positioned in the condenser length of the heat pipe. An evaporatable and condensable fluid partially fills the heat pipe with the remaining volume being occupied by a noncondensable gas which is positioned at least partly around the restriction member. By reducing the internal cross-section area of the heat pipe using the restriction member, the overall length of a practical working heat pipe can be reduced. The cross-sectional area of the restriction member can also be varied for changing the heat exchange characteristics of the heat pipe.

9 Claims, 5 Drawing Sheets

VARIABLE CONDUCTANCE HEAT PIPE ENHANCEMENT

FIELD AND BACKGROUND OF THE INVENTION

The present invention relates in general to the construction of heat pipes.

A heat pipe is a device for transmitting heat from one location to another with a small temperature gradient. The heat pipe has found varied applications in many fields since the first publication of its operating principles in 1964 by scientists at Los Alamos Scientific Laboratory. The book *Heat Pipe Theory and Practice* by S.W. Chi, McGraw-Hill 1976, provides information on heat pipes. Sections 1-2 and 1-3 of this reference cover heat pipe working fluids and wick structures, respectively. Section 1-4 is of primary interest for this disclosure since it covers control techniques for heat pipes. As stated in Section 1-4, heat pipes do not have any particular operating temperature. They adjust their temperature according to the heat-source and heat-sink conditions. In many cases, it is desirable to maintain certain portions of the heat pipe at a set temperature range even during variation in the heat-source and heat-sink conditions (variable conductance heat pipes). Major control approaches can be categorized into four classes: (1) condenser blocking with noncondensing gases (gas-loaded heat pipe), (2) condenser flooding with excess working fluid (excess-liquid heat pipe), (3) vapor flow control (vapor-flow modulated heat pipe), and (4) liquid flow control (liquid-flow modulated heat pipe).

The Hudson Products Corporation is currently marketing a heat pipe air heater for application to heat recovery in boilers. Gas-loaded variable conductance heat pipes have been proposed for use in Hudson's air heater. The gas-loaded heat pipe would be used as a passive technique for controlling surface temperatures to minimize or eliminate acid condensation on heat pipe surfaces. Work that was done in this connection, showed that gas-loaded heat pipes could be used in this application but for a typical 1.77 inch inside diameter heat pipe, a 9.7 foot long gas reservoir would be needed. This adds a significant length to the heat pipe.

U.S. Pat. No. 3,812,905 to Hamerdinger, et al discloses a heat pipe which employs a magnetic working fluid and a magnetizable member to form a hermetic seal in the wick and vapor passage areas of the heat pipe. In this way, the condenser length is variable so as to provide heat pipe control operating temperature and pressure by positioning the magnetizable member to some position along the length inside the heat pipe. Thus, the effective length of the condenser portion of the heat pipe is controlled.

U.S. Pat. No. 3,933,198 to Hara, et al relates to a heat transfer device (which includes heat pipes). This reference discloses the use of a movable plug which varies the pressure of a noncondensable gas in the vessel. A modified embodiment has a flexible relatively small vessel in the heat transfer device. The vessel is charged with some type of fluid from outside the vessel to vary the volume of the vessel, thus varying the pressure of the noncondensable gas.

U.S. Pat. No. 4,403,651 to Groke and U.S. Pat. No. 4,345,642 to Ernst, et al illustrate the state of the art concerning heat pipes.

U.S. Pat. No. 4,403,651 discloses a heat pipe with a hermetically sealed residual gas collector vessel provided in the inner chamber of the heat pipe. A narrow tube transfers any condensate to the collector vessel.

Of further interest is U.S. Pat. No. 3,614,981 to Coleman, et al which also discloses a restriction within the heat pipe.

SUMMARY OF THE INVENTION

The present disclosure is directed to a gas-loaded heat pipe. During normal operation, the heat pipe is filled with a working fluid over most of its length, with a noncondensable gas such nitrogen at one end. In boiler applications, a divider plate separates the exiting flue gas from the incoming air to be heated. Heat from the flue gas causes evaporation of the working fluid in the heat pipe. This fluid travels up the pipe and condenses over the active length of the pipe to transfer the heat to the incoming air.

In designing a gas-loaded heat pipe, there is a need to control the relation between noncondensable gas volume to the active condenser length. In a normal design effort, the designer has very limited options and must either extend the heat pipe length or add a larger cross-section reservoir.

The present invention adds a fixed restriction inside the heat pipe. The added restriction now allows the designer to optimize the relationship between active condenser length and noncondensable gas volume. The restriction may be located off center, x-ray have any geometric shape or cross-section, and may have flow passages on or within it to optimize the flow of vapor and condensate in the condenser. The restriction is mounted within the heat pipe and held in place by any established structure.

DESCRIPTION OF THE PREFERRED EMBODIMENTS

Figure 1:
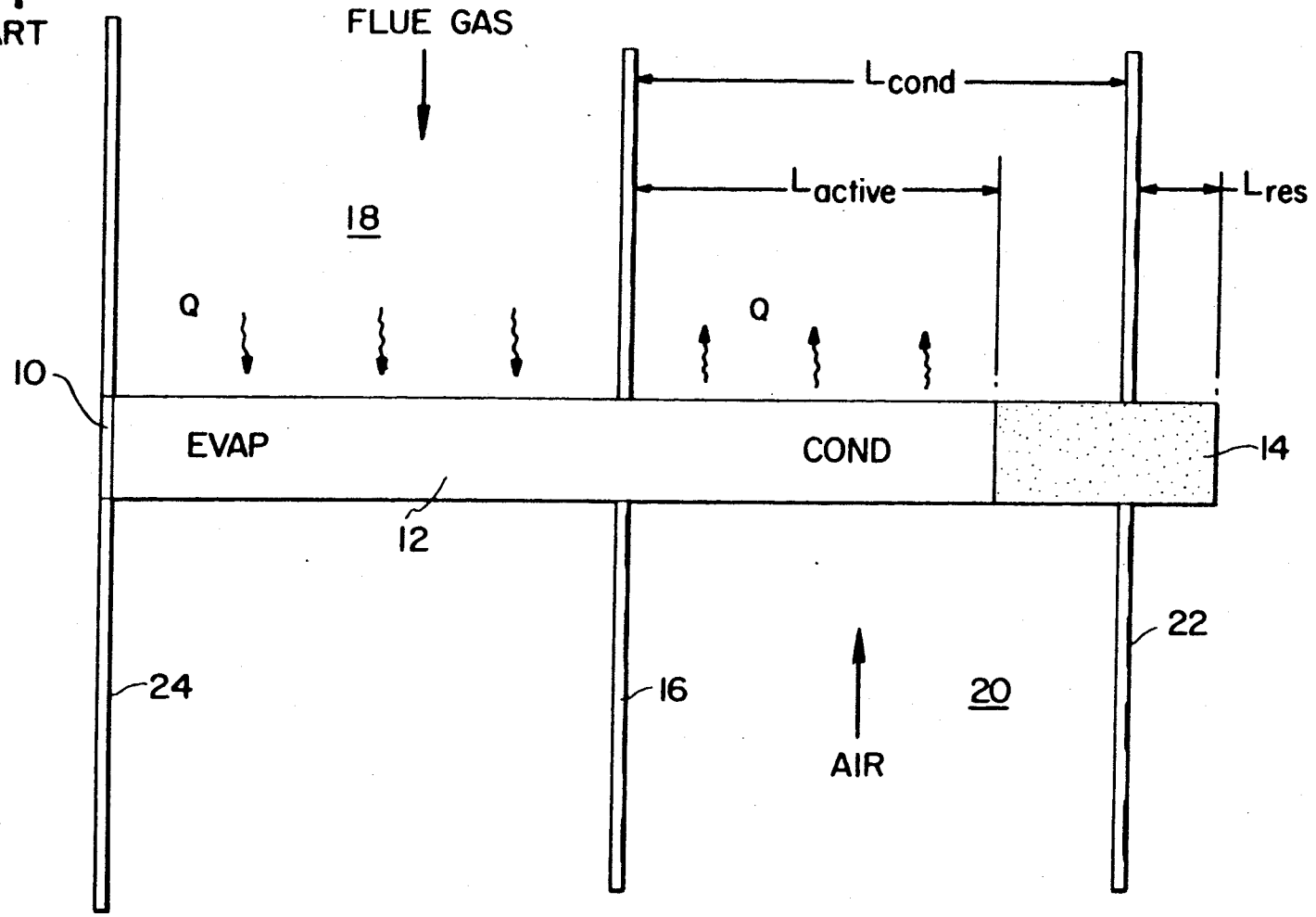
FIG. 1 PRIOR ART
FIG. 1 is a schematic sectional view of a known heat pipe structure used within a heat exchanger for heating air using the heat from flue gas.

Referring to the drawings in particular, FIG. 1 illustrates the operation of a conventional heat pipe.

FIG. 1 shows a gas-loaded heat pipe during normal operation. The heat pipe 10 is filled with a working fluid 12 over most of its length and a noncondensable gas 14 at one end. A divider plate 16 separates flowing flue gas 18 from air 20 to be heated. Heat from the flue gas, Q, causes evaporation of the working fluid 12 in the heat pipe 10. This fluid travels up the pipe (to the right in FIG. 1) and condenses over the active length of the pipe, L (active). This keeps the heat pipe hotter than the air and causes heat Q to be transferred to the air.

When the working fluid is hottest, it expands to its maximum volume. In this condition, the condenser portion of the heat pipe occupies L (cond) and the gas occupies L, which is the reservoir. The reservoir is usually separated from the air flow by a heat exchanger wall 22. Heat pipe 10 extends through walls 16 and 22 and is usually bonded at the bottom by a heat exchanger wall 24.

As heat pipe working fluid temperature decreases with decreasing load or inlet air temperature, the inert gas expands. The condenser length L (cond), is reduced to L (active) which decreases the heat transfer surface area. In designing a gas-loaded heat pipe, there is a need to control the relation between noncondensable gas volume to the active condenser length. In a heat pipe such as that shown in FIG. 1, the change in active length, Δ L, is related to the change in noncondensable gas volume, ΔV, as:

$$\Delta L = \Delta V / A \; \Delta\Delta \qquad (1)$$

where A is the inside cross-sectional area of the heat pipe 10. In a normal design effort, the heat pipe area, A, and desired change in condenser length, ΔL, are determined by other criteria. The designer then uses equation (1) to determine the volume change, ΔV, needed. Then, the temperature and pressure conditions for the heat pipe are used along with the desired volume change to determine the required reservoir volume. The designer has very limited options at this point and must either extend the heat pipe length or add a larger cross-section reservoir.

Figure 2:
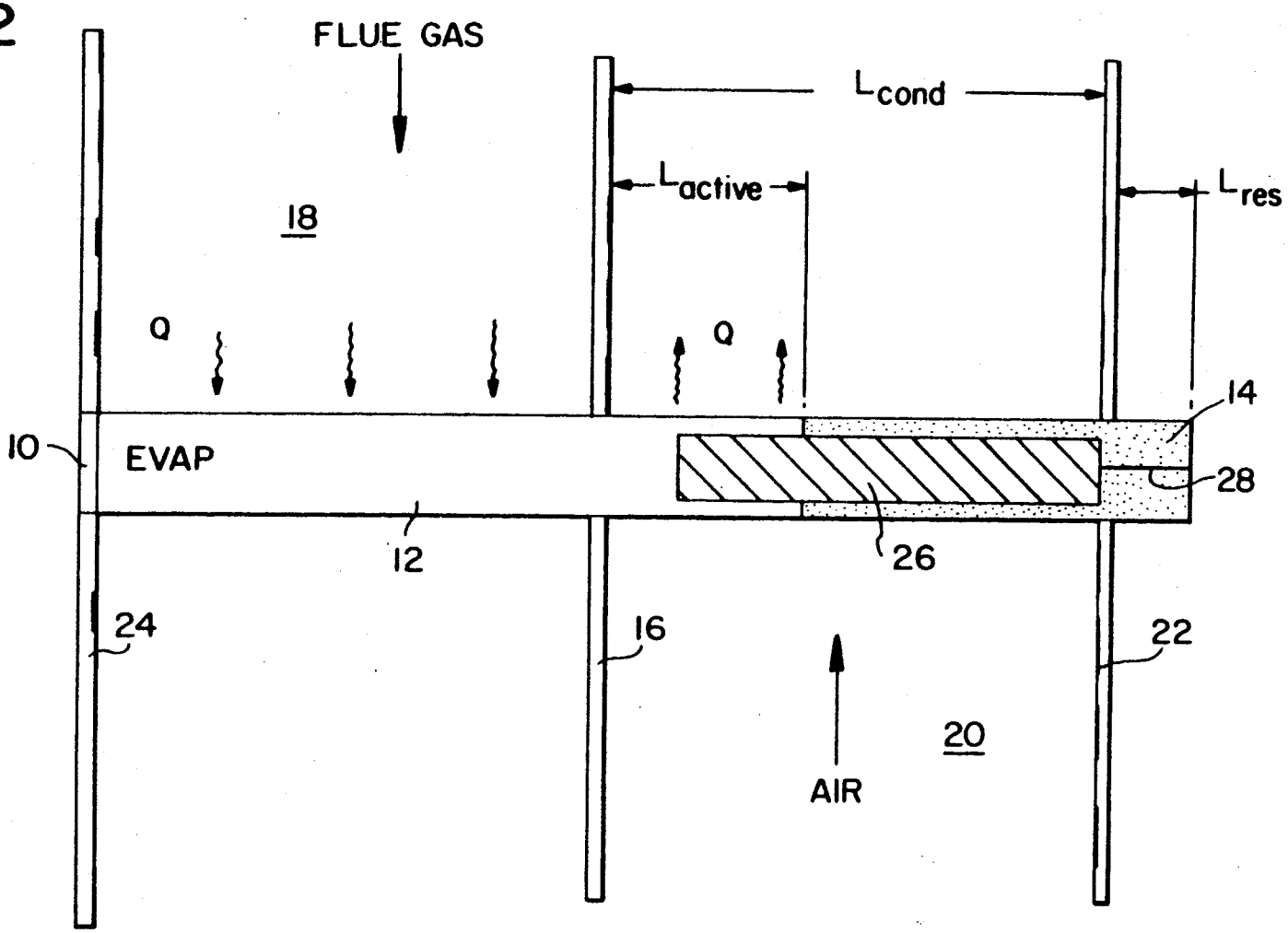
FIG. 2 is a view similar to FIG. 1 showing one embodiment of the present invention.

According to the present invention, a restriction with cross-sectional area "a" is provided inside the heat pipe. FIG. 2 shows the heat pipe 10 in the same environment as heat pipe 10 in FIG. 1 but with a restriction 26 added. In the figures, the same reference numerals are used to designate the same or similar elements. The restriction 26 changes the relationship in equation (1) to:

$$\Delta L = \Delta V / (A - a) \; \Delta\Delta \qquad (2)$$

One can now select "a" vs length to optimize the relationship between ΔL and ΔV. The restriction 26 is shown attached to the end cap of the heat pipe 10 by a small diameter fixed ligament 28 such as a steel pin. Restriction 26 may be a steel plug or rod.

The invention provides much more flexibility for the manufacture of the gas-loaded heat pipe. This flexibility allows for the same heat duty with a smaller heat exchanger or more heat duty with the same size heat exchanger. Examples of how one may use this flexibility follow:

The required length of the gas reservoir can be reduced. For example, if a rod 26 with half the cross-sectional area of the heat pipe 10 is used as the restriction, the reservoir length can be halved. This is important because the length of the heat pipe determines the external dimensions of the heat exchanger. Reduction in these dimensions has significant impact on the cost of the heat exchanger and retrofit possibilities.

Reduction can also be made to the diameter of the reservoir. For example, if a rod with half the cross-sectional area of the heat pipe is used, the reservoir diameter can be reduced by 30%. This is important because the presence of a large diameter reservoir at the end of the heat pipe complicates fabrication and assembly and may limit the range of allowable pitches for the heat exchanger.

Figure 3:
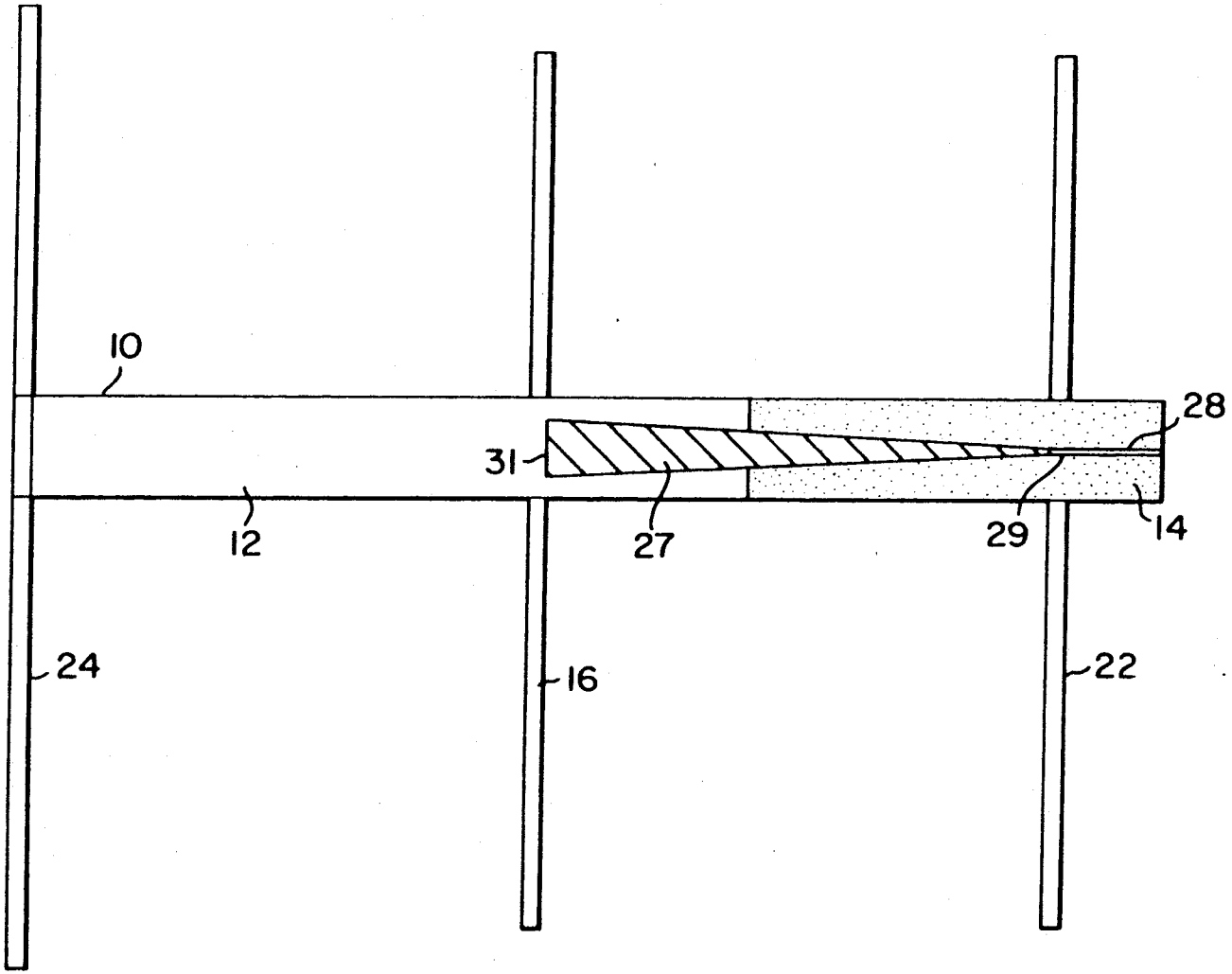
FIG. 3 is a view similar to FIG. 1 showing another embodiment of the invention.

The cross-sectional area of the restriction along the length can be varied to give a non-linear response to operating conditions. For example, if the constant diameter rod 26 of FIG. 2 were replaced by a conical restriction 27 in FIG. 3, with an apex 29 at the heat exchanger wall 22 and a base 31 at the divider place 16, a given change in noncondensable gas volume will cause a larger and larger change in condenser length as the active length decreases. This is important because one can customize the relationship between noncondensable gas volume and condenser length.

Another advantage of the invention is that the restriction is inside the heat pipe. Consequently, the heat pipe has no protrusions to complicate handling, and the device can go completely unnoticed by a user.

The restriction may also be located off center, may have any geometric shape or cross-section and may have flow passages on or within it to optimize the flow of vapor and condensate in the condenser. The restriction and ligament may be made from any material compatible with the working fluid and other heat pipe materials. The restriction may be mounted within the heat pipe and held in place by any established method.

The present invention achieves flexibility in design by using a simple fixed rod positioned within the active condenser end thereof, without requiring any movable elements within the heat pipe, and without requiring any external control mechanisms such as bellows, adjustable magnetic equipment or other complex arrangement as has hitherto been used in the prior art.

Figure 4:
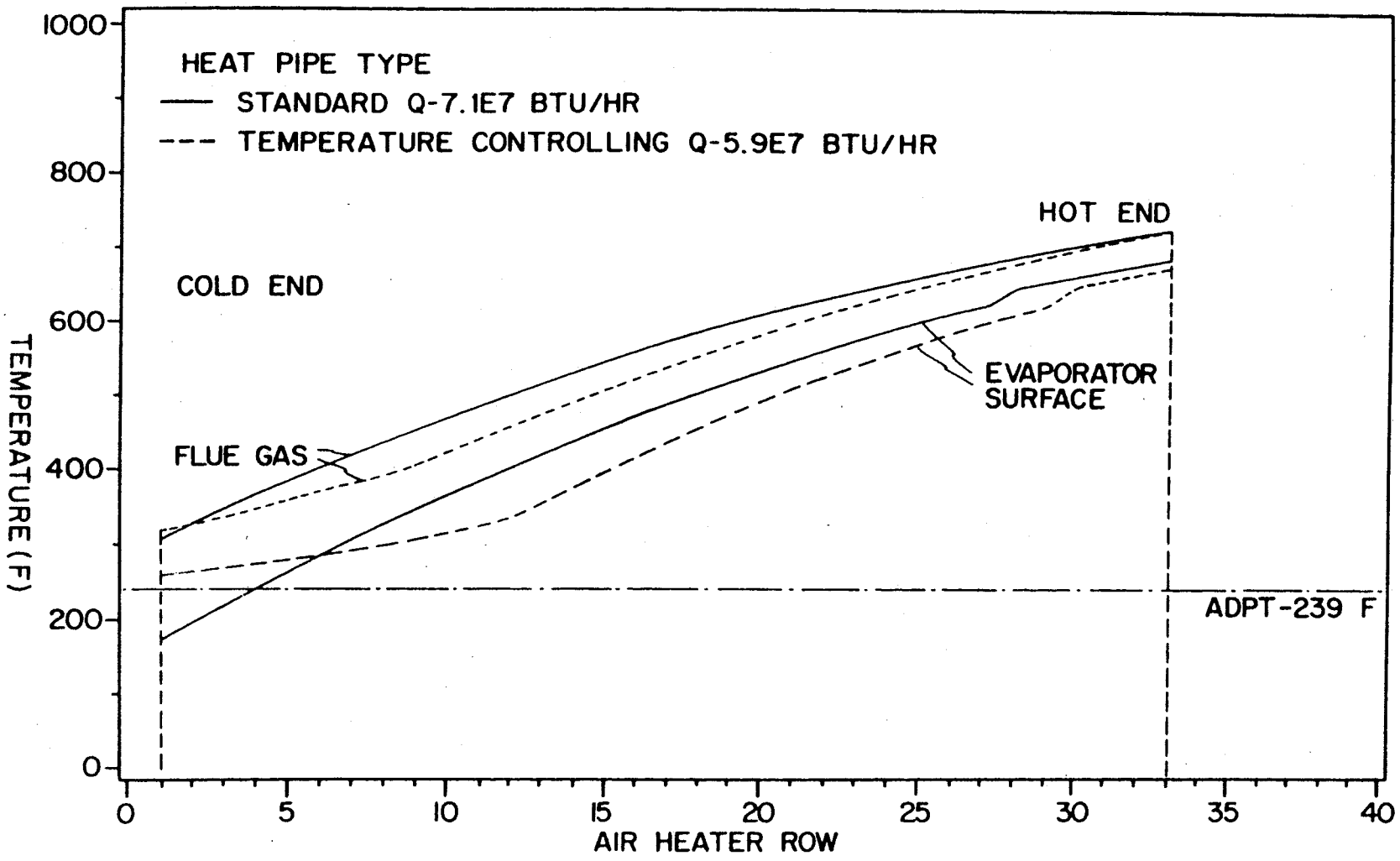
FIG. 4 is a graph showing an air heater analysis for a variable conductance heat pipe, illustrating the temperature distributions at full load.

FIG. 4 compares heat pipe operating temperatures at full load for standard and temperature controlling (variable conductance) heat pipes. The use of temperature controlling pipes prevents the evaporator surface temperature in the first three rows from dropping below the Acid Dew Point Temperature or ADPT.

Figure 5:
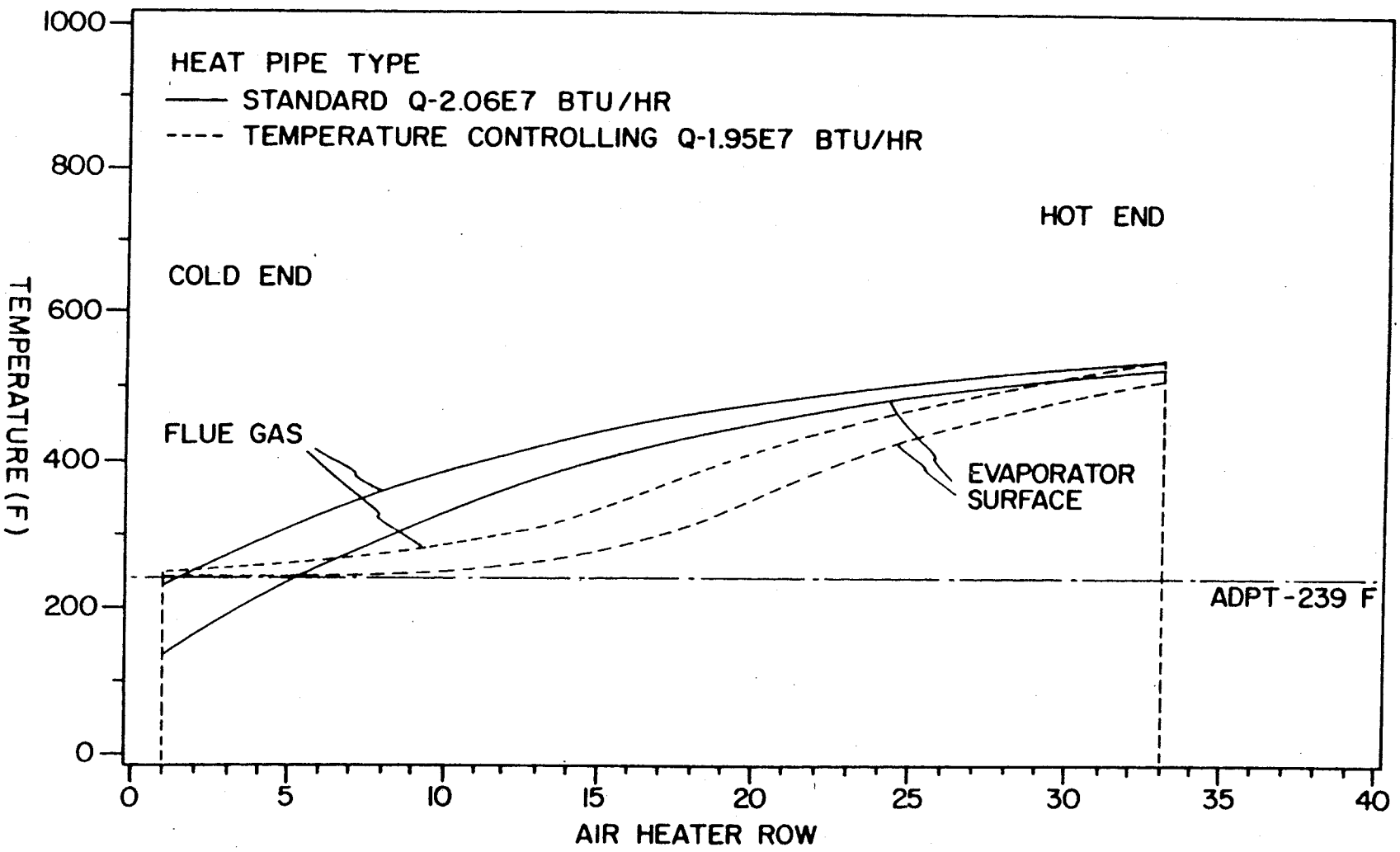
FIG. 5 is a graph similar to FIG. 4 showing the temperature distributions at low load.

FIG. 5 is similar but compares heat pipe operating temperatures at low load for standard and temperature controlling heat pipes. At low loads the temperature controlling pipes prevent the evaporator surface temperature in the first four rows from dropping below the ADPT.

This typical sizing analysis shows that temperature controlling heat pipes can be used to prevent operating temperatures below the acid dew point temperature for a typical large air heater application. To accomplish this, a 9.7 ft. long reservoir would have to be added to the end of the heat pipes making them 41.94 ft. long rather than 32.24 ft.

If the invention is applied however, and a solid rod with a 1.676 inch outside diameter is placed inside the heat pipe, the reservoir length can be reduced to one foot saving almost 9 feet of heat exchanger length. Similarly, the original reservoir can be reduced by a factor of two if a 1.252 inch rod is used. Also a variable area rod can be used that will accomplish the same function as shown in the FIGS. 4 and 5 but with fewer rows of heat pipes or with higher heat duty.

Details of a heat pipe air heater used in FIGS. 4 and 5 are:

Heat Pipes

Evaporator Length: 13.0 ft.
Condenser Length : 19.24 ft.
Adiabatic Length : 0.0
Heat Pipe Outside Diameter: 2.0 inches
Heat Pipe Inside Diameter : 1.77 inches
Gas Reservoir Length if Same Diameter as Heat Pipe: 9.7 ft.
Working Fluid: Water Heat Exchanger Number of Tubes: 60 tubes per row, 33 rows, 1980 tubes
Tilt Angle : 10 degrees Full Load Nominal Conditions Heal Duty 70,000,000 Btu/hr. 4D
Hot Gas Flow : 635,000 pounds per hour
Cold Gas Flow: 517,000 pounds per hour
Hot Gas Inlet Temperature 730 Degrees F.
Cold Gas Inlet Temperature : 80 Degrees F.
Cold Gas Outlet Temperature: 633 Degrees F.
Hot Gas Outlet Temperature : 309 Degrees F.

Low Load Nominal Conditions

Heat Duty 20,000,000 Btu/hr.
Hot Gas Flow : 262,000 pounds per hour
Cold Gas Flow: 194,000 pounds per hour
Hot Gas Inlet Temperature : 541 Degrees F.
Cold Gas Inlet Temperature : 80 Degrees F.
Cold Gas Outlet Temperature: 519 Degrees F.
Hot Gas Outlet Temperature : 231 Degrees F.
Acid Dew Point Temperature (ADPT): 239 Degrees F.

While specific embodiments of the invention have been shown and described in detail to illustrate the application of the principles of the invention, it will be understood that the invention may be embodied otherwise without departing from such principles.

What is claimed is:

1. A heat pipe assembly comprising:

a tubular hollow heat pipe having an evaporator end and an opposite condenser end, said heat pipe having a cross-sectional area and having a condenser length extending from said condenser end, said condenser length including an active length where evaporated fluid condenses;

an evaporatable and condensable fluid in said heat pipe for evaporating when receiving heat near said evaporation end and for condensing when giving up heat in said active length;

a noncondensable gas near said condenser end and in said condenser length of said heat pipe;

a restriction member fixed in said heat pipe near said condenser end, said restriction member extending only along a portion of the condenser length and being spaced away from the evaporation end of said heat pipe, said restriction member having a varied cross-sectional area along the length of said restriction member which is less than the cross-sectional area of said heat pipe for confining said gas and a portion of said fluid in the active condenser length, to an area around said restriction member and in said heat pipe; and a fixed ligament connected between said restriction member and said heat pipe for fixing said restriction member in said heat pipe, said ligament being fixed between said condenser end of said heat pipe end and an end of said restriction member which is closest to said condenser end.

2. An assembly according to claim 1, wherein the cross-sectional area of said restriction member is approximately one-half of the cross-sectional area of said heat pipe.

3. An assembly according to claim 1, wherein said restriction member is centered in said heat pipe.

4. An assembly according to claim 1, wherein said restriction member is off-center in said heat pipe.

5. A heat pipe assembly comprising:

a tubular hollow heat pipe having an evaporator end and an opposite condenser end, said heat pipe having a cross-sectional area and having a condenser length extending from said condenser end, said condenser length including an active length where evaporated fluid condenses:

an evaporatable and condensable fluid in said heat pipe for evaporating when receiving heat near said evaporation end and for condensing when giving up heat in said active length;

a noncondensable gas near said condenser end and in said condenser length of said heat pipe;

a restriction member fixed in said heat pipe near said condenser end, said restriction member extending only along a portion of the condenser length and being spaced away from the evaporation end of said heat pipe, said restriction member having a cross-sectional area which is less than the cross-sectional area of said heat pipe for confining said gas and a portion of said fluid in the active condenser length, to an area around said restriction member and in said heat pipe, said restriction member being conical with an apex nearest said condenser end and a base nearest said evaporation end; and a fixed ligament connected between said restriction member and said heat pipe for fixing said restriction member in said heat pipe, said ligament being fixed between said condenser end of said heat pipe end and an end of said restriction member which is closest to said condenser end.

6. An assembly according to claim 5, including a ligament connected between said condenser end and the apex of said restriction member for fixing said restricting member in said heat pipe.

7. A heat pipe assembly comprising:

a tubular hollow heat pipe having an evaporator end and an opposite condenser end, said heat pipe having a cross-sectional area and having a condenser length extending from said condenser end, said condenser length including an active length where evaporated fluid condenses;

an evaporatable and condensable fluid in said heat pipe for evaporating when receiving heat near said evaporation end and for condensing when giving up heat in said active length;

a noncondensable gas near said condenser end and in said condenser length of said heat pipe;

a restriction member fixed in said heat pipe near said condenser end, said restriction member extending only along a portion of the condenser length and being spaced away from the evaporation end of said heat pipe, said restriction member having a cross-sectional area which is less than the cross-sectional area of said heat pipe for confining said gas and a portion of said fluid in the active condenser length, to an area around said restriction member and in said heat pipe;

a fixed ligament connected between said restriction member and said heat pipe for fixing said restriction member in said heat pipe, said ligament being fixed between said condenser end of said heat pipe end and an end of said restriction member which is closest to said condenser end; and a partition wall through which said heat pipe extends, the condenser length of said heat pipe being positioned on one side of said partition wall facing said condenser end, a heat exchanger wall through which said heat pipe extends, said heat exchanger wall being spaced from said partition wall and being adjacent said condenser end for defining an end of said condenser length adjacent said condenser end, said restriction member extending from said heat exchanger wall toward said partition wall, a portion of said heat pipe from said heat exchanger wall to said condenser end defining a reservoir for containing a portion of the gas.

8. An assembly according to claim 7, wherein said restriction member is cylindrical.

9. An assembly according to claim 7, wherein said restriction member is conical with an apex connected to said ligament and a base spaced from said ligament.

* * * * *